US012691484B2

(12) United States Patent
Goto et al.

(10) Patent No.: US 12,691,484 B2
(45) Date of Patent: Jul. 28, 2026

(54) PRESS BRAKE AND TABLE DRIVING METHOD FOR PRESS BRAKE

(71) Applicant: AMADA CO., LTD., Kanagawa (JP)

(72) Inventors: Shintaro Goto, Kanagawa (JP); Kenji Abe, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 183 days.

(21) Appl. No.: 18/853,567

(22) PCT Filed: Apr. 4, 2023

(86) PCT No.: PCT/JP2023/013928
§ 371 (c)(1),
(2) Date: Oct. 2, 2024

(87) PCT Pub. No.: WO2023/199795
PCT Pub. Date: Oct. 19, 2023

(65) Prior Publication Data

US 2025/0229313 A1 Jul. 17, 2025

(30) Foreign Application Priority Data

Apr. 13, 2022 (JP) ..... 2022-066193

(51) Int. Cl.
*B21D 5/02* (2006.01)

(52) U.S. Cl.
CPC ..... *B21D 5/02* (2013.01)

(58) Field of Classification Search
CPC .. B21D 5/02; B21D 5/00; B30B 15/12; B30B 15/10; B30B 1/00; B30B 1/26; B30B 1/32; F16D 11/00; F16D 11/14; F16D 67/02
See application file for complete search history.

(56) References Cited

U.S. PATENT DOCUMENTS 4,805,439 A * 2/1989 Kobayashi ..... B21D 5/02 72/701

FOREIGN PATENT DOCUMENTS

JP 3884352 B2 * 2/2007 ..... B30B 1/18

OTHER PUBLICATIONS

Translation of JP-3884352.*

(Continued)

*Primary Examiner* — Bobby Yeonjin Kim
(74) *Attorney, Agent, or Firm* — Renner, Otto, Boisselle & Sklar, LLP

(57) ABSTRACT

A clutch includes: a first clutch tooth that rotates integrally with a first rotation element included in a speed reducer; a second clutch tooth that rotates integrally with a second rotation element included in the speed reducer; and a fixed clutch tooth that moves between the first clutch tooth and the second clutch tooth. The fixed clutch tooth includes: a first mode in which the speed reducer operates at a second reduction ratio by meshing only with the first clutch tooth to fix the first rotation element, a second mode in which the speed reducer operates at a first reduction ratio by meshing only with the second clutch tooth to fix the second rotation element, and a both-engaging mode of meshing with each of the first clutch tooth and the second clutch tooth when changing a mode between the first mode and the second mode.

12 Claims, 7 Drawing Sheets

(56) References Cited

OTHER PUBLICATIONS

Extended European Search Report for corresponding EP Application No. 23788214.7 dated Jul. 8, 2025.
International Search Report for corresponding Application No. PCT/JP2023/013928, mailed Jun. 27, 2023.
Written Opinion for corresponding Application No. PCT/JP2023/013928, mailed Jun. 27, 2023.

* cited by examiner

PRESS BRAKE AND TABLE DRIVING METHOD FOR PRESS BRAKE

TECHNICAL FIELD

The present disclosure relates to a press brake and a table driving method for the press brake.

BACKGROUND ART

Conventionally, there has been known a press brake which bends a workpiece by moving a movable table on which a tool such as a punch is attached to the up-down direction with respect to a fixed table to which a tool such as a die is attached. A method using an electric motor has been known as a method for driving the moving table in addition to a method using hydraulic pressure.

For example, Patent Literature 1 discloses a technology of performing a high-speed movement and a low-speed movement of a movable table with one electric motor by switching a reduction ratio of a speed reducer.

CITATION LIST

Patent Literature

[Patent Literature 1] Japanese Patent NO. 3884352

SUMMARY OF THE INVENTION

However, in order to acquire sufficient operation performance of a press brake, it is necessary to set a sufficiently large reduction ratio during a low-speed movement. In addition, since the movable table, which is a heavy body, receives a large downward force due to its own weight, it is necessary to prevent the movable table from descending unexpectedly. It is necessary to satisfy these requirements, and thus the table driving for the press brake using an electric motor has room for improvement.

An aspect of the present disclosure is a press brake including: a movable table that is disposed opposite to a fixed table in an up-down direction; a conversion mechanism that moves the movable table in the up-down direction by converting a rotation motion into a linear motion; an electric motor provided with an electric motor shaft; a speed reducer that includes a mechanical paradox planetary gear mechanism, and outputs a rotation of the electric motor shaft to the conversion mechanism by reducing the rotation of the electric motor shaft at either a first reduction ratio or a second reduction ratio larger than the first reduction ratio; and a clutch that switches a reduction ratio in the speed reducer between the first reduction ratio and the second reduction ratio, in which the clutch includes: a first clutch tooth that is connected to a first rotation element included in the speed reducer and rotates integrally with the first rotation element; a second clutch tooth that is connected to a second rotation element included in the speed reducer and rotates integrally with the second rotation element; and a fixed clutch tooth that is provided between the first clutch tooth and the second clutch tooth disposed to be opposite to each other such that a tooth structure of the first clutch tooth and a tooth structure of the second clutch tooth face each other, and moves between the first clutch tooth and the second clutch tooth, and the fixed clutch tooth includes: as a switchable operation mode, a first mode in which the speed reducer operates at the second reduction ratio by meshing only with the first clutch tooth to fix the first rotation element; a second mode in which the speed reducer operates at the first reduction ratio by meshing only with the second clutch tooth to fix the second rotation element; and a both-engaging mode of meshing with each of the first clutch tooth and the second clutch tooth when changing a mode between the first mode and the second mode.

According to an aspect of the present disclosure, since the speed reducer includes a mechanical paradox planetary gear mechanism, a sufficiently large second reduction ratio can be acquired. In addition, since the fixed clutch tooth operates in a both-engaging mode when changing a mode between a first mode and a second mode, the movable table, which is a heavy body, can be maintained in an immovable state.

According to an aspect of the present disclosure, it is possible to prevent the movable table, which is a heavy body, from descending unexpectedly while acquiring necessary operation performance as a press brake.

DETAILED DESCRIPTION OF THE INVENTION

A press brake and a table driving method for the press brake according to a present embodiment will be described below with reference to the drawings.

Figure 1:
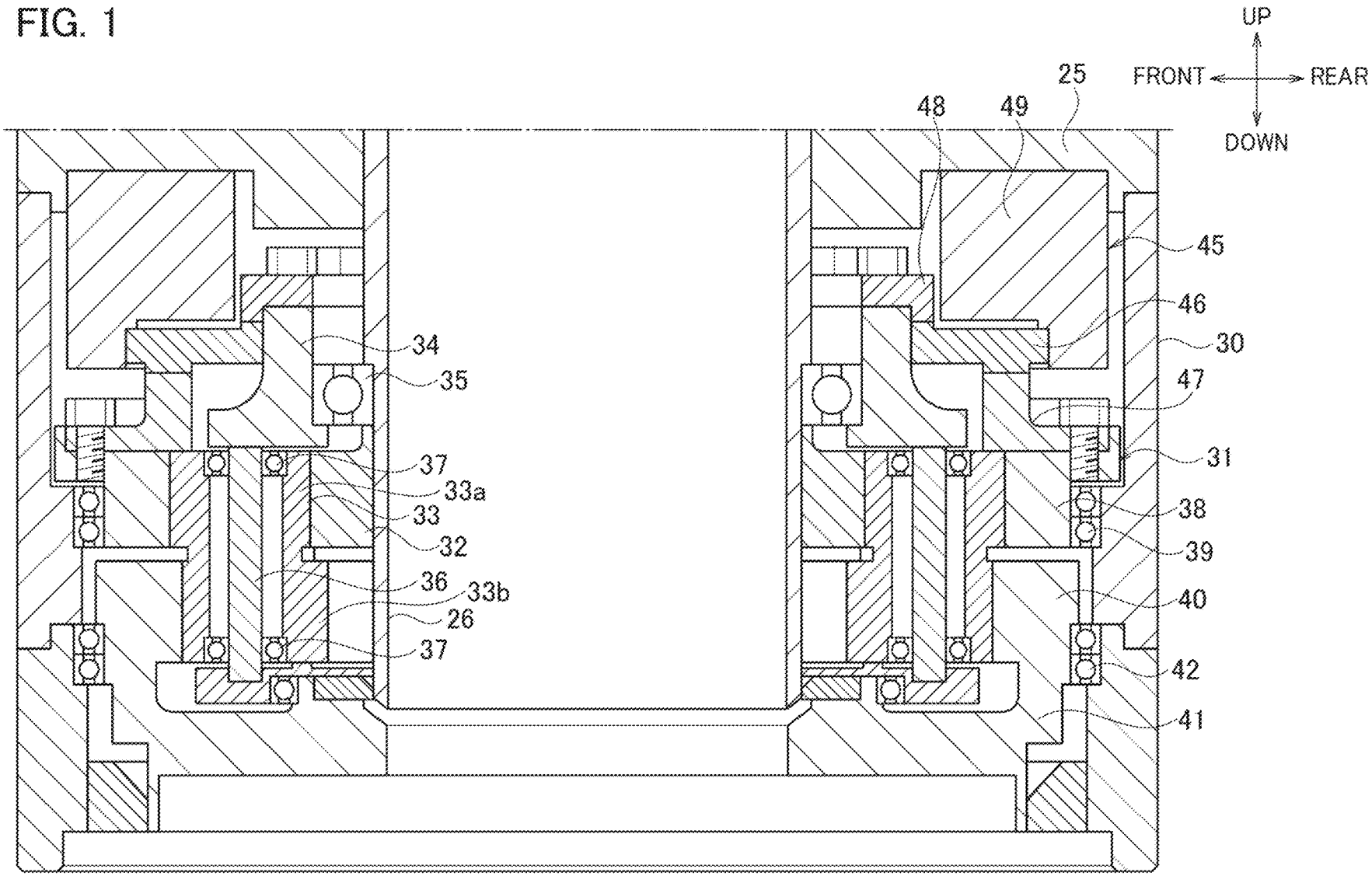
FIG. 1 is a cross-sectional view illustrating a main portion of a table driving device of a press brake.
Figure 2:
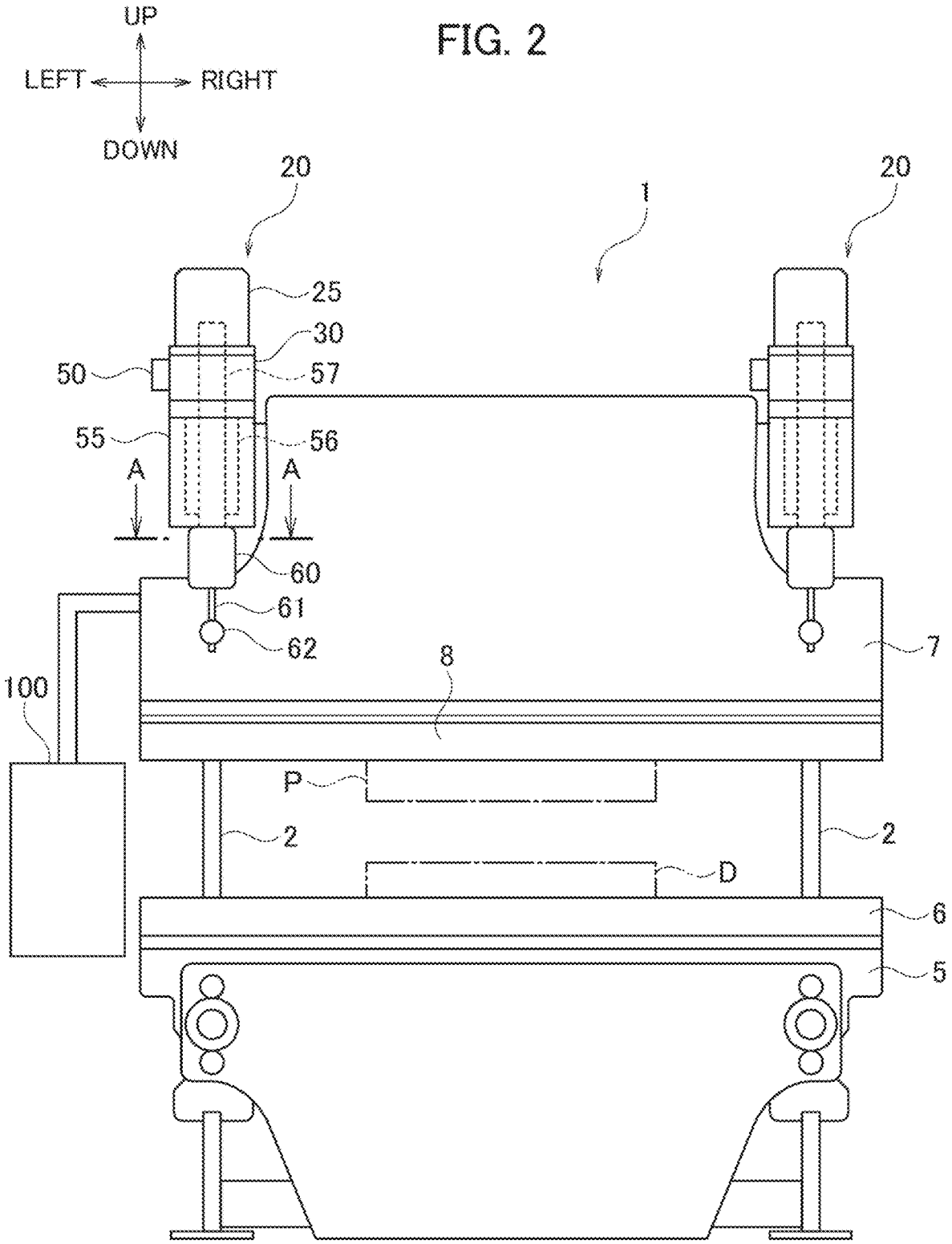
FIG. 2 is a front view illustrating a structure of the press brake.

FIG. 1 is a cross-sectional view illustrating an main portion of a table driving device of a press brake. FIG. 2 is a front view illustrating a structure of the press brake. In describing the structure of the press brake, a left-right direction, a front-rear direction, and an up-down direction are used as definitions of directions. The left-right direction and the front-rear direction correspond to two directions orthogonal to each other in the horizontal direction, and the up-down direction corresponds to the vertical direction. However, these directions are used only for the sake of convenience to explain the press brake and the table driving method for the press brake according to the present embodiment.

A press brake 1 according to the present embodiment includes: an upper table 7 that is disposed opposite to a lower table 5 in an up-down direction; a ball screw mechanism 55 that moves the upper table in the up-down direction by converting a rotation motion into a linear motion; an electric motor 25 provided with an electric motor shaft 26; a speed reducer 31 that includes a mechanical paradox planetary gear mechanism, and outputs a rotation of the electric motor shaft 26 to the ball screw mechanism 55 by reducing the rotation of the electric motor shaft 26 at either a first reduction ratio or a second reduction ratio larger than the first reduction ratio; and a clutch 45 that switches a reduction ratio in the speed reducer 31 between the first reduction ratio and the second reduction ratio. The clutch 45 includes: a first clutch tooth 47 that is connected to a first rotation element included in the speed reducer 31 and rotates integrally with the first rotation element; a second clutch tooth 48 that is connected to a second rotation element included in the speed reducer 31 and rotates integrally with the second rotation element; and a fixed clutch tooth 46 that is provided between the first clutch tooth 47 and the second clutch tooth 48 disposed to be opposite to each other such that the first clutch tooth 47 and the second clutch tooth 48 face each other, and moves between the first clutch tooth 47 and the second clutch tooth 48. The fixed clutch tooth 46 includes: as a switchable operation mode, a first mode in which the speed reducer 31 operates at the second reduction ratio by meshing only with the first clutch tooth 47 to fix the first rotation element; a second mode in which the speed reducer 31 operates at the first reduction ratio by meshing only with the second clutch tooth 48 to fix the second rotation element; and a both-engaging mode of meshing with each of the first clutch tooth 47 and the second clutch tooth 48 when changing a mode between the first mode and the second mode.

First Embodiment

Figure 3:
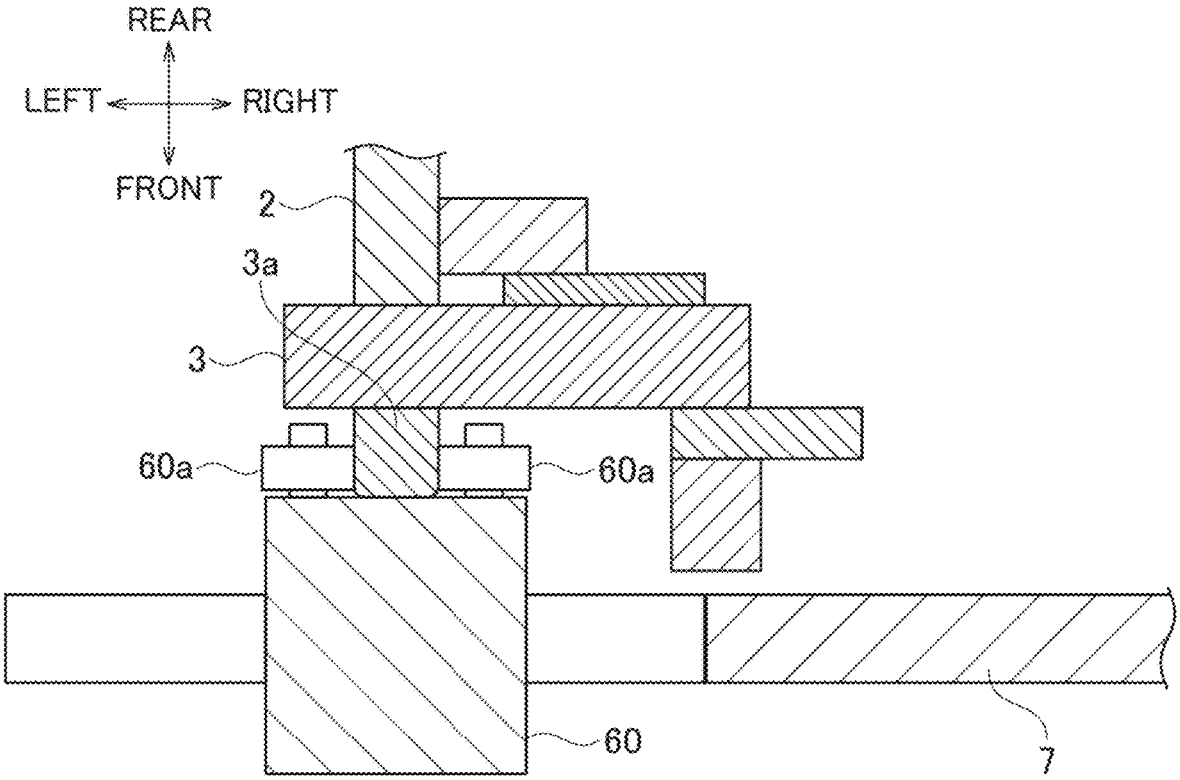
FIG. 3 is a diagram illustrating an AA cross-section of FIG. 2.
Figure 4:
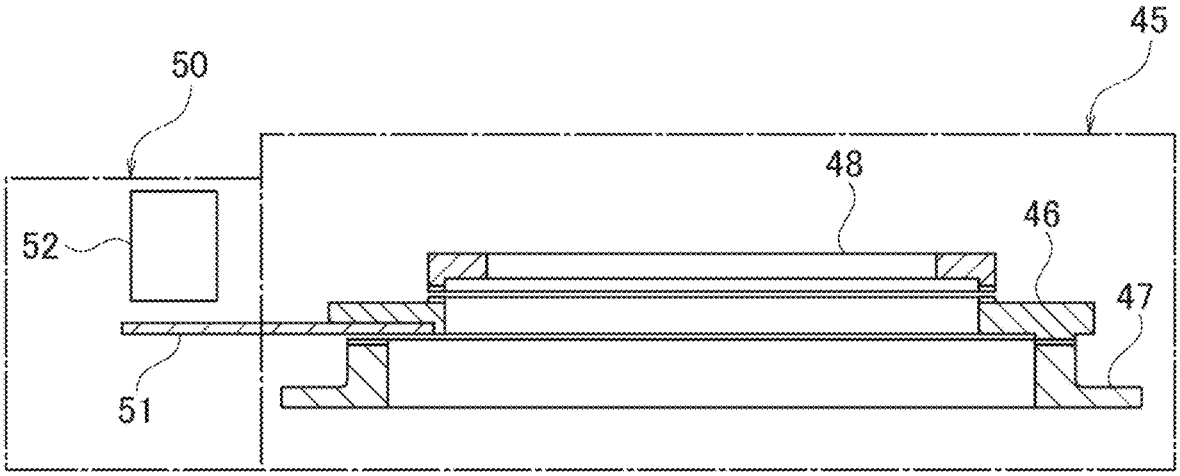
FIG. 4 is an explanatory diagram illustrating a detection device for detecting a position of a fixed clutch tooth.

A press brake 1 according to a first embodiment will be described in detail below with reference to FIGS. 1 to 4. FIG. 3 is a diagram illustrating an AA cross-section of FIG. 2. FIG. 4 is an explanatory diagram illustrating a detection device for detecting a position of a fixed clutch tooth.

The press brake 1 bends a plate-like workpiece such as a sheet metal in cooperation with an upper tool P such as a punch and a lower tool D such as a die. The press brake 1 includes right and left side frames 2, a lower table 5 as a fixed table, an upper table 7 as a movable table, right and left table driving devices 20, and a control device 100.

The right and left side frames 2 are spaced apart in the left-right direction such that they are opposite to each other.

The lower table 5 extends in the left-right direction and is supported by the front lower portions of the right and left side frames 2. On the upper side of the lower table 5, a lower tool holder 6 for detachably holding a lower tool D is provided along the left-right direction. A holder groove for holding the base (shank) of the lower tool D is formed in the lower tool holder 6 along the left-right direction.

The upper table 7 extends in the left-right direction and is supported by the front upper portions of the left and right side frames 2. The upper table 7 is configured to be movable in the up-down direction with respect to the left and right side frames 2.

On the lower side of the upper table 7, an upper tool holder 8 for detachably holding an upper tool P is provided along the left-right direction. A holder groove for holding the base (shank) of the upper tool P is formed in the upper tool holder 8 along the left-right direction.

The right and left table driving devices 20 are fixed to the respective upper portions of the left and right side frames 2, respectively. The respective table driving devices 20 move the upper table 7 in the up-down direction. The table driving device 20 is mainly configured of an electric motor 25, a speed reducer unit 30, and a ball screw mechanism 55.

The electric motor 25 is a servomotor, for example, and includes an electric motor shaft 26 rotating around a shaft line. The speed reducer unit 30 reduces the rotation of the electric motor shaft 26 by a predetermined reduction ratio and outputs the reduced rotation to the ball screw mechanism 55. The speed reducer unit 30 is mainly configured of a speed reducer 31 and a clutch 45, the details of which will be described later.

The ball screw mechanism 55 moves the upper table 7 in the up-down direction by converting a rotation motion of an output unit 41 of the speed reducer unit 30 into a linear motion. The ball screw mechanism 55 includes a ball screw nut 56 and a ball screw shaft 57. The ball screw nut 56 is axially supported inside the housing of the ball screw mechanism 55 via a bearing. The ball screw nut 56 is connected to the output unit 41 of the speed reducer unit 30 and rotates according to the rotation of the output unit 41. The ball screw shaft 57 is screwed to the ball screw nut 56 and moves in the up-down direction as the ball screw nut 56 rotates forward and backward.

A connection block 60 is connected to the lower end of the ball screw nut 56. A suspension bolt 61 that hangs in the up-down direction is attached to the lower end of the connection block 60, and the suspension bolt 61 supports a support shaft 62 that penetrates the upper table 7 in the front-rear direction. The ball screw nut 56 is connected to the upper table 7 via the connection block 60, the suspension bolt 61, and the support shaft 62. With this structure, the upper table 7 moves in the up-down direction according to the movement of the ball screw shaft 57 in the up-down direction.

As illustrated in FIG. 3, a pair of restricting rollers **60*a* separated in the left-right direction are provided on the rear surface of the connection block 60. A roller guide 3*a* extending in the up-down direction is provided on the front surface of the support member 3 provided on the side frame 2. The roller guide 3*a* is clamped by the pair of restricting rollers 60*a* provided on the connection block 60**.

As illustrated in FIG. 2, the control device 100, such as a numerical control (NC) device for controlling the operation of the press brake 1, is supported in the left side frame 2 via a connecting arm. The control device 100 controls the speed reducer unit 30 and the electric motor 25.

In the press brake 1 having such a structure, a workpiece is positioned on the lower tool D attached to the lower tool holder 6 of the lower table 5. When the upper table 7 having the upper tool P attached to the upper tool holder 8 descends toward the lower table 5, the workpiece is pressurized between the upper tool P and the lower tool D. The workpiece is bent at a desired bending angle in cooperation with the upper tool P and the lower tool D.

Figure 5A:
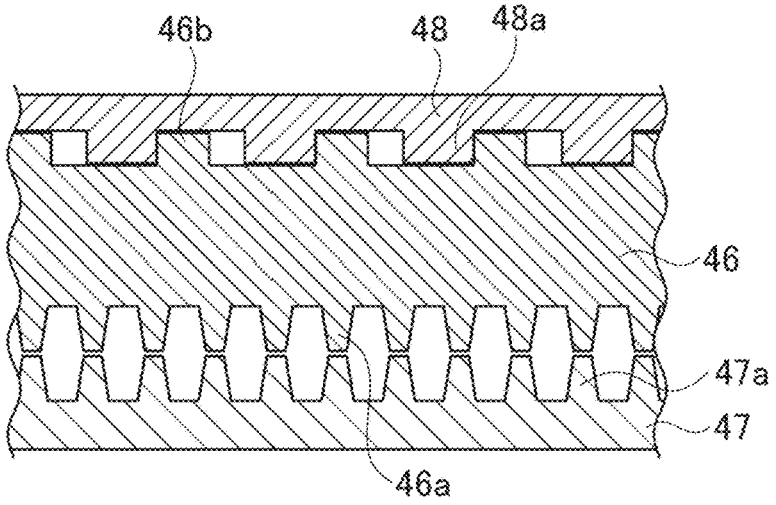
FIG. 5A is an explanatory diagram illustrating a second mode of the fixed clutch tooth.
Figure 5B:
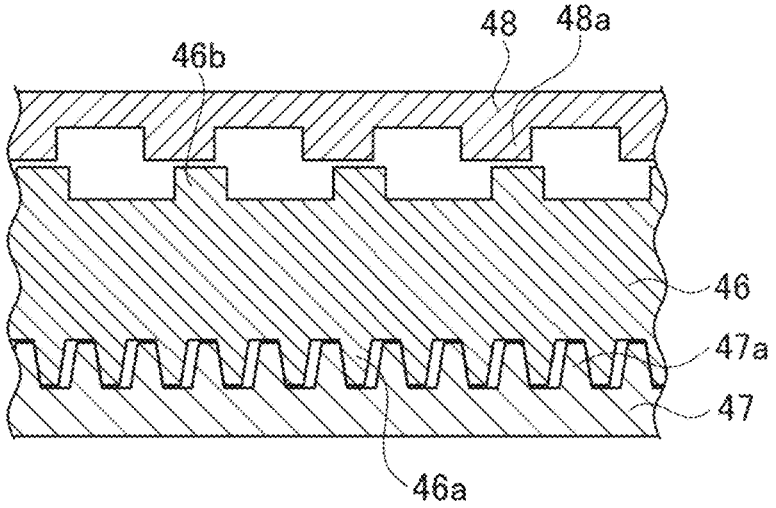
FIG. 5B is an explanatory diagram illustrating a first mode of the fixed clutch tooth.
Figure 5C:
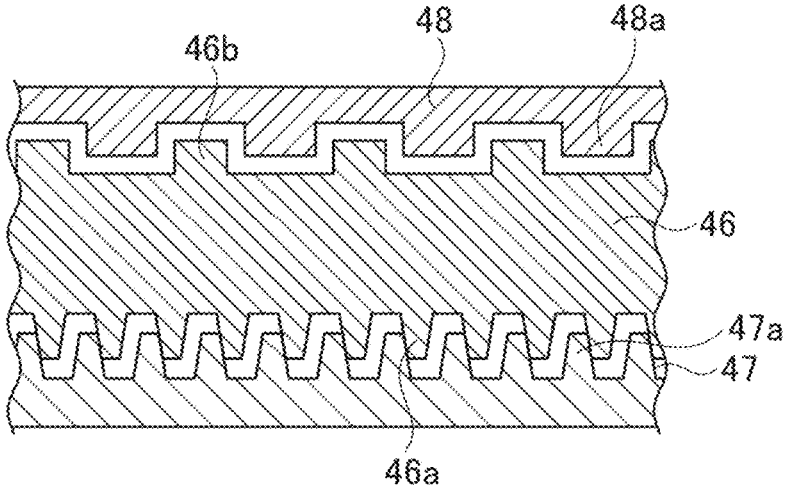
FIG. 5C is an explanatory diagram illustrating a both-engaging mode of the fixed clutch tooth.

The speed reducer unit 30 will be described in detail below with reference to FIGS. 1 and 4, and FIGS. 5A to 5C. FIG. 4 is an explanatory diagram illustrating a detection device for detecting a position of a fixed clutch tooth. FIG. 5A is an explanatory diagram illustrating a second mode of the fixed clutch tooth. FIG. 5B is an explanatory diagram illustrating a first mode of the fixed clutch tooth. FIG. 5C is an explanatory diagram illustrating a both-engaging mode of the fixed clutch tooth.

As illustrated in FIG. 1, the speed reducer unit 30 includes the speed reducer 31 and the clutch 45. The speed reducer 31 reduces a rotation of the electric motor shaft 26 at either a first reduction ratio or a second reduction ratio larger than the first reduction ratio, and outputs the reduced rotation. The clutch 45 switches a reduction ratio in the speed reducer 31 between the first reduction ratio and the second reduction ratio.

The speed reducer 31 includes a mechanical paradox planetary gear mechanism. Specifically, the speed reducer 31 includes a sun gear 32, a plurality of planetary gear units 33, a planetary carrier 34, a first internal gear 38, a second internal gear 40, and an output unit 41.

The sun gear 32 is externally fitted with the outer peripheral surface of the electric motor shaft 26. The sun gear 32 rotates integrally with the electric motor shaft 26.

The plurality of planetary gear units 33 are provided around the sun gear 32, and are equally spaced in the circumferential direction. Each of the planetary gear units 33 includes a first planetary gear 33*a* and a second planetary gear 33*b*. The first planetary gear 33*a* meshes with the sun gear 32 and rotates according to the rotation of the sun gear 32. The second planetary gear 33*b* is provided coaxially with the first planetary gear 33*a*, and rotates integrally with the first planetary gear 33*a*. In the present embodiment, the first planetary gear 33*a* and the second planetary gear 33*b* have a two-stage structure that is integrated in the up-down direction, and the first planetary gear 33*a* and the second planetary gear 33*b* rotate on the same axis.

The planetary carrier 34 rotates around the electric motor shaft 26 via a bearing 35 externally fitted with the electric motor shaft 26. The planetary carrier 34 is provided with a plurality of unit shafts 36 along the circumferential direction. A bearing 37 is externally fitted with each of the unit shafts 36, and the planetary gear unit 33 is attached thereto via the bearing 37. The planetary carrier 34 rotatably supports each of the plurality of planetary gear units 33.

The first internal gear 38 is an internal gear engaged with the first planetary gear 33*a*. The first internal gear 38 is provided on the inner peripheral surface of the housing of the speed reducer unit 30 via the bearing 39, and can rotate around the electric motor shaft 26.

The second internal gear 40 has the number of teeth different from those of the first internal gear 38, and is an internal gear engaged with the second planetary gear 33*b*. The second internal gear 40 is provided on the inner peripheral surface of the housing of the speed reducer unit 30 via the bearing 42, and can rotate around the electric motor shaft 26.

The output unit 41 is integrally formed with the second internal gear 40 and rotates integrally with the second internal gear 40. The output unit 41 is connected to the ball screw nut 56 of the ball screw mechanism 55 described above.

The clutch 45 includes a fixed clutch tooth 46, a first clutch tooth 47, and a second clutch tooth 48. Each of the fixed clutch tooth 46, the first clutch tooth 47, and the second clutch tooth 48 is an annular member, and has a tooth structure as described later. The first clutch tooth 47 and the second clutch tooth 48 are disposed to be opposite to each other such that a tooth structure of the first clutch tooth 47 and a tooth structure of the second clutch tooth 48 face each other. The fixed clutch tooth 46 is provided between the first clutch tooth 47 and the second clutch tooth 48.

The fixed clutch tooth 46 moves between the first clutch tooth 47 and the second clutch tooth 48. The fixed clutch tooth 46 is restricted from moving in a direction other than the up-down direction including a rotation in the circumferential direction. As illustrated in FIGS. 5A to 5C, the fixed clutch tooth 46 is provided with a plurality of first engaging teeth 46*a* along the circumferential direction and a plurality of second engaging teeth 46*b* along the circumferential direction. Each of the first engaging teeth 46*a* projects toward the first clutch tooth 47, and each of the second engaging teeth 46*b* projects toward the second clutch tooth 48.

As illustrated in FIG. 1, the first clutch tooth 47 is connected to the first internal gear 38, which is a first rotation element and included in the speed reducer 31, and rotates integrally with the first internal gear 38. As illustrated in FIGS. 5A to 5C, the first clutch tooth 47 is provided with a plurality of third engaging teeth 47*a* along the circumferential direction. Each of the third engaging teeth 47*a* projects toward the fixed clutch tooth 46 and the second clutch tooth 48 side.

As illustrated in FIG. 1, the second clutch tooth 48 is connected to the planetary carrier 34, which is a second rotation element and included in the speed reducer 31, and rotates integrally with the planetary carrier 34. As illustrated in FIGS. 5A to 5C, the second clutch tooth 48 is provided with a plurality of fourth engaging teeth 48*a* along the circumferential direction. Each of the fourth engaging teeth 48*a* projects toward the fixed clutch tooth 46 and the first clutch tooth 47 side.

As illustrated in FIG. 1, the clutch 45 includes a pressing member (not illustrated) and a solenoid 49. The pressing member is, for example, a compression coil spring, and presses the fixed clutch tooth 46 toward the first clutch tooth 47 side. That is, the fixed clutch tooth 46 normally moves toward the first clutch tooth 47 side when receiving the pressing force of the pressing member. Meanwhile, the solenoid 49 moves the fixed clutch tooth 46 toward the second clutch tooth 48 side by attracting the fixed clutch tooth 46 using an electromagnetic force. That is, when the solenoid 49 is operated to attract the fixed clutch tooth 46 by an electromagnetic force, the fixed clutch tooth 46 moves toward the second clutch tooth 48 side against the pressing force of the pressing member.

The clutch 45 further includes a capacitor (not illustrated) that supplies power to the solenoid 49 when external power to the solenoid 49 is interrupted.

As illustrated in FIG. 4, the press brake 1 further includes a detection device 50 for detecting the position of the fixed clutch tooth 46 between the first clutch tooth 47 and the second clutch tooth 48. The position of the fixed clutch tooth 46 detected by the detection device 50 is output to the control device 100.

The detection device 50 includes a detection plate 51 and a sensor 52.

The detection plate 51 is a plate elongated in one direction, and has one end fixed to the fixed clutch tooth 46 and the other end extended to the outside of the housing of the clutch 45. The detection plate 51 moves in the direction of the shaft line of the electric motor shaft 26 according to the movement of the fixed clutch tooth 46.

The sensor 52 is provided outside the housing of the clutch 45. The sensor 52 is fixed to a predetermined position above the detection plate 51, that is, a predetermined position on the second clutch tooth 48 side with respect to the fixed clutch tooth 46. The sensor 52 is, for example, a proximity sensor, and detects the detection plate 51 which is displaced according to the movement of the fixed clutch tooth 46. Specifically, the sensor 52 detects whether the detection plate 51 is positioned close to the sensor 52 or whether the detection plate 51 is positioned far from the sensor 52. When the sensor 52 detects that the detection plate 51 is positioned close to the sensor 52, it can be determined that the fixed clutch tooth 46 is positioned on the second clutch tooth 48 side, that is, in the second mode described later. When the sensor 52 detects that the detection plate 51 is positioned far from the sensor 52, it can be determined that the fixed clutch tooth 46 is positioned on the first clutch tooth 47 side, that is, in the first mode described later.

As a feature of the present embodiment, the fixed clutch tooth 46 has three operation modes as switchable operation modes. As illustrated in FIGS. 5A to 5C, the three operation modes include the first mode, the second mode, and the both-engaging mode.

As illustrated in FIG. 5B, the first mode is a mode in which the fixed clutch tooth 46 meshes only with the first clutch tooth 47. In the first mode, the plurality of first engaging teeth 46*a* of the fixed clutch tooth 46 and the plurality of third engaging teeth 47*a* of the first clutch tooth 47 mesh with each other. In contrast, the plurality of second engaging teeth 46*b* of the fixed clutch tooth 46 and the plurality of fourth engaging teeth 48*a* of the second clutch tooth 48 are released. The first clutch tooth 47 is fixed when the fixed clutch tooth 46 meshes with the first clutch tooth 47, thereby restricting the rotation of the first internal gear 38. In this case, the speed reducer 31 operates at a large reduction ratio (second reduction ratio).

As illustrated in FIG. 5A, the second mode is a mode in which the fixed clutch tooth 46 meshes only with the second clutch tooth 48. In the second mode, the plurality of second engaging teeth 46*b* of the fixed clutch tooth 46 and the plurality of fourth engaging teeth 48*a* of the second clutch tooth 48 mesh with each other. In contrast, the plurality of first engaging teeth 46*a* of the fixed clutch tooth 46 and the plurality of third engaging teeth 47*a* of the first clutch tooth 47 are released. The second clutch tooth 48 is fixed when the fixed clutch tooth 46 meshes with the second clutch tooth 48, thereby restricting the rotation of the planetary carrier 34. In this case, the speed reducer 31 operates at a reduction ratio (first reduction ratio) smaller than the second reduction ratio.

As illustrated in FIG. 5C, the both-engaging mode is a mode that operates when a mode of the fixed clutch tooth 46 changes from the first mode to the second mode, or conversely, when a mode of the fixed clutch tooth 46 changes from the second mode to the first mode. In the both-engaging mode, the fixed clutch tooth 46 meshes with each of the first clutch tooth 47 and the second clutch tooth 48. In the both-engaging mode, the plurality of first engaging teeth 46*a* of the fixed clutch tooth 46 and the plurality of third engaging teeth 47*a* of the first clutch tooth 47 mesh with each other. Similarly, the plurality of second engaging teeth 46*b* of the fixed clutch tooth 46 and the plurality of fourth engaging teeth 48*a* of the second clutch tooth 48 mesh with each other. In this case, each of the first clutch tooth 47 and the second clutch tooth 48 is fixed, thereby restricting the rotation of the planetary carrier 34 and the first internal gear 38.

A table driving method for the press brake 1 according to the present embodiment will be described below with reference to FIGS. 1 and 2, and FIGS. 5A to 5C.

A workpiece is positioned between the upper tool P and the lower tool D. The control device 100 causes the solenoid 49 to perform an attracting operation. As a result, the fixed clutch tooth 46 moves toward the second clutch tooth 48 side, and thus the fixed clutch tooth 46 enters the second mode of meshing only with the second clutch tooth 48 (FIG. 5A).

The control device 100 operates the electric motor 25 to rotate the electric motor shaft 26 forward. In the second mode, the planetary carrier 34 is fixed, but the first internal gear 38 is released. Since the planetary carrier 34 is fixed, the first planetary gear 33*a* meshing with the first internal gear 38 rotates without revolving according to the rotation of the sun gear 32, which rotates integrally with the electric motor shaft 26. Meanwhile, since the rotation of the first planetary gear 33*a* also causes the second planetary gear 33*b* to rotate integrally with the first planetary gear 33*a*, the second internal gear 40 also rotates according to the rotation of the second planetary gear 33*b*. As a result, the output unit 41 coupled with the second internal gear 40 also rotates synchronously. At this time, the rotation of the electric motor shaft 26 is output to the output unit 41 as a simple planetary gear mechanism without being decelerated by the mechanical paradox planetary gear mechanism. That is, the reduction ratio of the speed reducer 31 enters the first reduction ratio. Therefore, an output of the high-speed low torque is output to the output unit 41, and the upper table 7 descends at high speed.

When the upper table 7 has descended to a predetermined switching position, the control device 100 stops the rotation of the electric motor shaft 26. Thereafter, the control device 100 terminates the attracting operation of the solenoid 49. As a result, the fixed clutch tooth 46 moves toward the first clutch tooth 47 side, and thus the fixed clutch tooth 46 enters the first mode of meshing only with the first clutch tooth 47 (FIG. 5B).

Thereafter, the control device 100 operates the electric motor 25 to rotate the electric motor shaft 26 backward. In the first mode, the first internal gear 38 is fixed, but the planetary carrier 34 is released. Therefore, the first planetary gear 33*a* that is engaged with the first internal gear 38 revolves around the sun gear 32 rotating integrally with the electric motor shaft 26 while rotating. Since the rotation of the first planetary gear 33*a* also causes the second planetary gear 33*b* to rotate integrally with the first planetary gear 33*a*, the rotation of the second planetary gear 33*b* also rotates the second internal gear 40 having the different number of teeth from those of the first internal gear 38. As a result, the output unit 41 coupled with the second internal gear 40 also rotates synchronously. At this time, the rotation of the electric motor shaft 26 is substantially decelerated by the mechanical paradox planetary gear mechanism, and is output to the output unit 41. That is, the reduction ratio of the speed reducer 31 enters the second reduction ratio which is larger than the first reduction ratio. Therefore, an output of the low-speed high torque is output to the output unit 41, and the upper table 7 descends at low speed.

When the upper table 7 has reached a predetermined pressure position, the workpiece is bent by the upper tool P and the lower tool D with a large force, and is bent to a desired angle.

After stopping the electric motor shaft 26 from rotating backward, the control device 100 rotates the electric motor shaft 26 forward. At this time, the rotation of the electric motor shaft 26 is substantially decelerated by the mechanical paradox planetary gear mechanism, and is output to the output unit 41. As a result, the upper table 7 ascends at low speed.

When the upper table 7 has ascended to a predetermined switching position, the control device 100 stops the rotation of the electric motor shaft 26. Thereafter, the control device 100 causes the solenoid 49 to perform an attracting operation. As a result, the fixed clutch tooth 46 moves toward the second clutch tooth 48 side, and thus the fixed clutch tooth 46 enters the second mode of meshing only with the second clutch tooth 48.

The control device 100 operates the electric motor 25 to rotate the electric motor shaft 26 backward. At this time, the rotation of the electric motor shaft 26 is output to the output unit 41 as a simple planetary gear mechanism without being decelerated by the mechanical paradox planetary gear mechanism. As a result, the upper table 7 ascends at high speed.

Finally, when the upper table 7 has moved to a predetermined ascending end, the control device 100 stops the rotation of the electric motor shaft 26. Through the operation described above, a series of bending steps is completed.

In the series of steps described above, when a mode of the fixed clutch tooth 46 changes between the first mode and the second mode, the fixed clutch tooth 46 operates in the both-engaging mode. Therefore, at the time of switching the fixed clutch tooth 46, each of the planetary carrier 34 and the first internal gear 38 is fixed. Although the upper table 7, which is a heavy body, receives a large downward force due to its own weight, since the rotation of the planetary carrier 34 and the first internal gear 38 is restricted, the upper table 7 is maintained in an immovable state.

Thus, according to the present embodiment, since the speed reducer 31 includes the mechanical paradox planetary gear mechanism, a sufficiently large reduction ratio (second reduction ratio) can be acquired. Thus, the operation performance required for the press brake 1 can be sufficiently acquired. Further, the fixed clutch tooth 46 operates in the both-engaging mode when changing the mode between the first mode and the second mode. Accordingly, the upper table 7, which is a heavy body, is maintained in an immovable state, and thus the upper table 7 can be prevented from descending unexpectedly.

Here, a clutch structure described in Patent Literature 1 will be described as a comparative example. In the clutch structure according to the comparative example, the reduction ratio on the high-speed side and the reduction ratio on the low-speed side are switched by the up-down movement of the clutch cylinder. In the clutch structure, the gear trains (A-side gear train and B-side gear train) constituted of a group of the first to third gears are provided at the two upper and lower positions, and the engaging gears (A-side engaging gear and B-side engaging gear) are provided in the clutch cylinder at the two upper and lower positions corresponding to the gear trains at the two upper and lower gear positions. At the time of switching the clutch cylinder, each of the engaging gears switches the gear to be meshed with the engaging gear from among a group of the gears constituting the corresponding gear trains. That is, at the time of switching the clutch, a case occurs in which each of the lower and upper engaging gears meshes with a new gear. In order to smoothly switch the clutch cylinder, a certain amount of clearance is required between the teeth of the engaging gears and the teeth of the gears on the gear train side when viewed in the circumferential direction. However, when the clutch is switched, the gear may rotate by the amount of the clearance, and thus the upper table 7 may descend according to the rotation of the gear.

In this respect, in the clutch 45 according to the present embodiment, when switching the fixed clutch tooth 46, there is only one clutch tooth (the first clutch tooth 47 or the second clutch tooth 48) with which the fixed clutch tooth 46 newly meshes. Therefore, the clutch 45 according to the present embodiment makes it possible to reduce the clearance in size required between the engaging teeth compared to the structure of the comparative example in which the engaging gears mesh with two respective gears. This makes it possible to prevent the upper table 7 from descending in a more positive way.

In the present embodiment, the speed reducer 31 includes: the sun gear 32 that rotates integrally with the electric motor shaft 26; a plurality of planetary gear units 33 having the first planetary gear 33*a* that is engaged with the sun gear 32 and rotates according to a rotation of the sun gear 32, and the second planetary gear 33*b* that is provided coaxially with the first planetary gear 33*a* and rotates integrally with the first planetary gear 33*a*; the planetary carrier 34 as the second rotation element that rotatably supports the plurality of planetary gear units 33 and rotates around the electric motor shaft 26; the first internal gear 38 as the first rotation element that is engaged with the first planetary gear 33*a*; the second internal gear 40 that has the number of teeth different from those of the first internal gear 38 and is engaged with the second planetary gear 33*b*; and the output unit 41 that is connected to the ball screw mechanism 55 and rotates integrally with the second internal gear 40.

This structure makes it possible for the speed reducer 31 to output the rotation of the electric motor shaft 26 to the output unit 41 as a simple planetary gear mechanism (first reduction ratio), or to the output unit 41 as a mechanical paradox planetary gear mechanism (second reduction ratio). Accordingly, a sufficiently large second reduction ratio can be acquired compared to the first reduction ratio, and thus the operation performance required for the press brake 1 can be sufficiently acquired.

In the present embodiment, the fixed clutch tooth 46 is an annular member having a plurality of first engaging teeth 46*a*, each of which projects toward the first clutch tooth 47 side, and a plurality of second engaging teeth 46*b*, each of which projects toward the second clutch tooth 48 side, provided along the circumferential direction. The first clutch tooth 47 is an annular member having a plurality of third engaging teeth 47*a*, each of which projects toward the second clutch tooth 48 side, provided along the circumferential direction. The second clutch tooth 48 is an annular member having a plurality of fourth engaging teeth 48*a*, each of which projects toward the first clutch tooth 47 side, provided along the circumferential direction.

According to this structure, since the engaging teeth opposed to each other are configured to engage with each other, the engagement with the first clutch tooth 47 or the second clutch tooth 48 can be easily performed by moving the fixed clutch tooth 46 in the up-down direction. Further, since the fixed clutch tooth 46 is positioned between the first clutch tooth 47 and the second clutch tooth 48, an area can be set where the fixed clutch tooth 46 is engaged with both the first clutch tooth 47 and the second clutch tooth 48. Thus, when a mode of the fixed clutch tooth 46 changes between the first mode and the second mode, the fixed clutch tooth 46 can be operated in the both-engaging mode.

In the present embodiment, in the first mode, a rotation of the first internal gear 38 is restricted in a state in which the plurality of first engaging teeth 46*a* and the plurality of third engaging teeth 47*a* mesh with each other, and the plurality of second engaging teeth 46*b* and the plurality of fourth engaging teeth 48*a* are released. In the second mode, a rotation of the planetary carrier 34 is restricted in a state in which the plurality of second engaging teeth 46*b* and the plurality of fourth engaging teeth 48*a* mesh with each other, and the plurality of first engaging teeth 46*a* and the plurality of third engaging teeth 47*a* are released. In the both-engaging mode, the plurality of first engaging teeth 46*a* and the plurality of third engaging teeth 47*a* mesh with each other and the plurality of second engaging teeth 46*b* and the plurality of fourth engaging teeth 48*a* mesh with each other, thereby restricting a rotation of the first internal gear 38 and the planetary carrier 43.

This structure makes it possible to acquire a sufficiently large second reduction ratio in the first mode compared to the first reduction ratio acting in the second mode. Thus, the operation performance required for the press brake 1 can be sufficiently acquired. The fixed clutch tooth 46 restricts the rotation of the first internal gear 38 and the planetary carrier 43 when changing the mode between the first mode and the second mode. Accordingly, the upper table 7, which is a heavy body, is maintained in an immovable state, and thus the upper table 7 can be prevented from descending unexpectedly.

In the present embodiment, the clutch 45 further includes: the pressing member that presses the fixed clutch tooth 46 toward the first clutch tooth 47 side; and the solenoid 49 that moves the fixed clutch tooth 46 that is pressed toward the first clutch tooth 47 side by the pressing member toward the second clutch tooth 48 side by attracting the fixed clutch tooth 46 using an electromagnetic force.

This structure makes it possible to drive the fixed clutch tooth 46 by utilizing the magnetic attraction of the solenoid 49 and the pressing force of the pressing member. This makes it possible to easily perform switching between the first mode and the second mode.

In the present embodiment, the press brake 1 further includes: the detection device 50 that detects a position of the fixed clutch tooth 46 between the first clutch tooth 47 and the second clutch tooth 48; and the control device 100 that controls the clutch 45 and the electric motor 25 based on a detection result of the detection device 50.

This structure makes it possible for the control device 100 to appropriately control the clutch 45 and the electric motor 25, while referring to the position of the fixed clutch tooth 46.

In the present embodiment, the detection device 50 includes: the detection plate 51 that is fixed to the fixed clutch tooth 46 and extended to the outside of the housing for housing the clutch 45; and the sensor 52 that is disposed outside the housing and detects the detection plate 51.

According to this structure, the detection plate 51 moves up and down in synchronization with the movement of the fixed clutch tooth 46. By detecting the detection plate 51 using the sensor 52, the position of the fixed clutch tooth 46, that is, the mode in which the fixed clutch tooth 46 is, can be detected.

In the present embodiment, the clutch 45 further includes a capacitor that supplies power to the solenoid 49 when external power to the solenoid 49 is interrupted.

According to this structure, the electric power for exciting the solenoid 49 can be supplied by the capacitor. Since the movement of the fixed clutch tooth 46 on the second clutch tooth 48 side can be prevented from moving toward the first clutch tooth 47 when the power source is lost, a case can be prevented in which the clutch 45 is damaged due to interference between the engaging teeth.

Second Embodiment

A press brake 1 according to a second embodiment will be described below. One of the features of the press brake 1 according to the second embodiment is a method of controlling the clutch 45 when changing a mode between the first mode and the second mode. Hereinafter, the method of controlling the clutch 45 will be described below with reference to FIGS. 6A to 6D. Here, FIGS. 6A to 6D are diagrams for explaining the method of controlling the clutch according to the second embodiment.

Figure 6A:
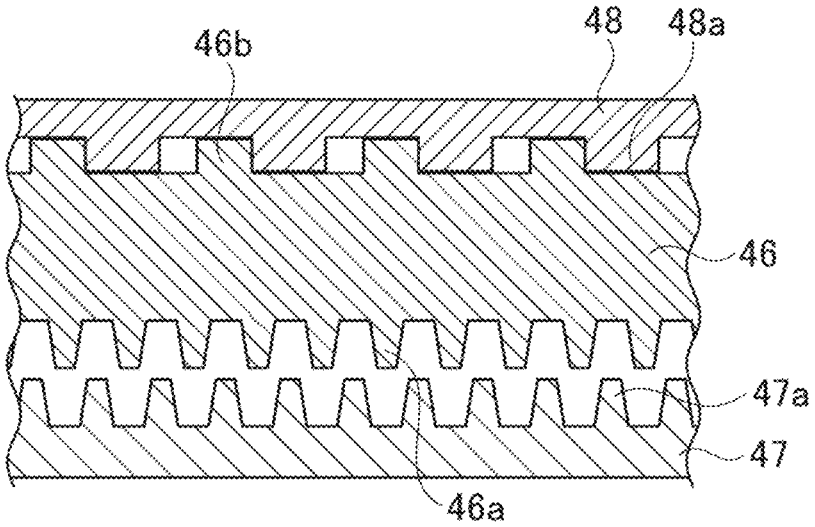
FIG. 6A is a diagram illustrating a method of controlling a clutch according to a second embodiment.

In the following description, a case will be assumed in which a mode of the fixed clutch tooth 46 is switched from the second mode to the first mode. When stopping the rotation of the electric motor shaft 26 of the electric motor 25, a force for rotating the second clutch tooth 48 in the circumferential direction acts due to the weight of the upper table 7. As a result, as illustrated in FIG. 6A, the plurality of second engaging teeth 46*b* of the fixed clutch tooth 46 and the plurality of fourth engaging teeth 48*a* of the second clutch tooth 48 are in close contact with each other in the circumferential direction.

For this reason, even when the attracting operation of the solenoid 49 is terminated, the fixed clutch tooth 46 and the second clutch tooth 48 will wear out due to the frictional force between the fixed clutch tooth 46 and the second clutch tooth 48. Moreover, in some cases, a mode of the fixed clutch tooth 46 may not be changed to the first mode in a normal manner.

Figure 6B:
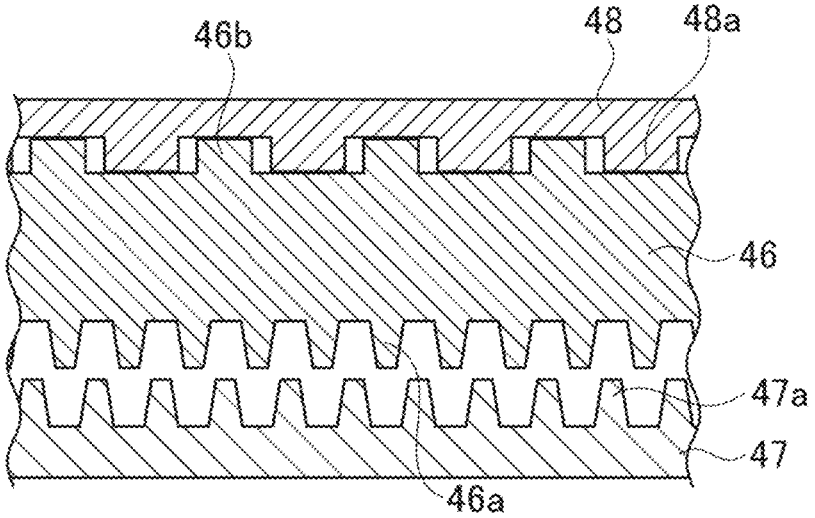
FIG. 6B is a diagram illustrating the method of controlling the clutch according to the second embodiment.

Therefore, the control device 100 slightly rotates the electric motor shaft 26 of the electric motor 25 in the direction in which the upper table 7 ascends. As the second clutch tooth 48 rotates, a clearance can be provided between the second engaging teeth 46*b* and the fourth engaging teeth 48*a* as illustrated in FIG. 6B.

Figure 6C:
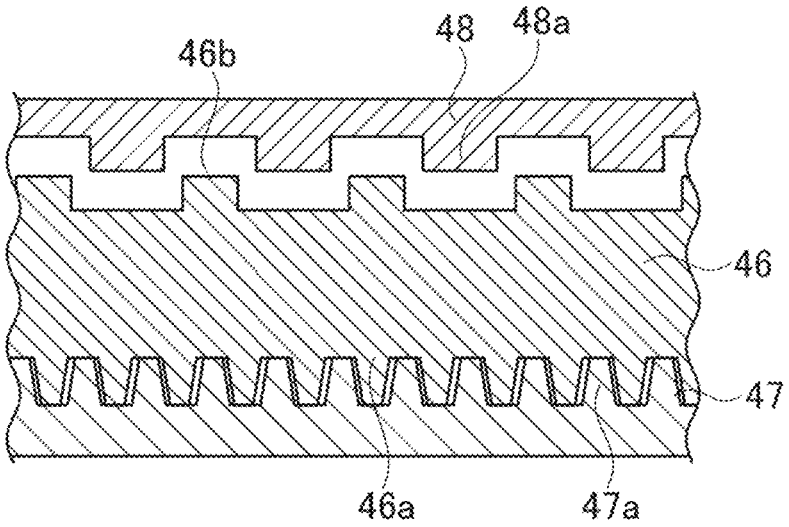
FIG. 6C is a diagram illustrating the method of controlling the clutch according to the second embodiment.
Figure 6D:
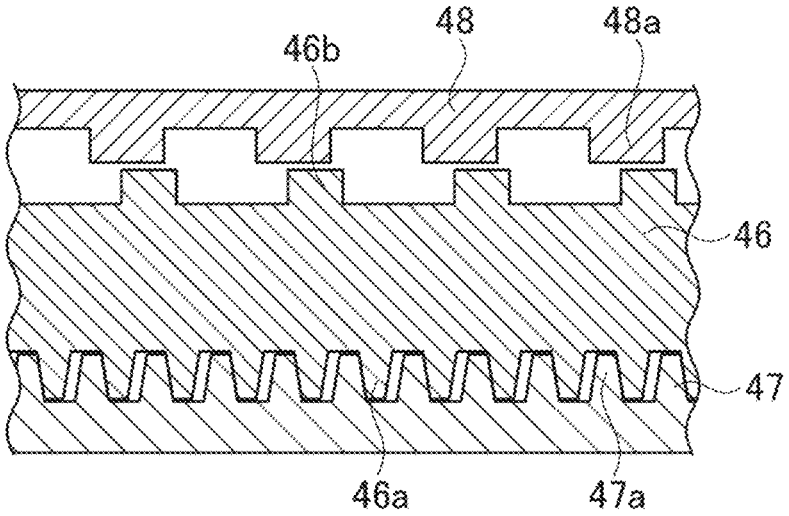
FIG. 6D is a diagram illustrating the method of controlling the clutch according to the second embodiment.

Accordingly, as illustrated in FIG. 6C, the fixed clutch tooth 46 can move toward the first clutch tooth 47 side, and thus a mode of the fixed clutch tooth 46 can be changed to the first mode. When a mode of the fixed clutch tooth 46 has changed to the first mode, a force for rotating the first clutch tooth 47 in the circumferential direction (the direction opposite to that in FIG. 6A) acts due to the weight of the upper table 7. The plurality of first engaging teeth 46*a* of the fixed clutch tooth 46 and the plurality of third engaging teeth 47*a* of the first clutch tooth 47 are in close contact with each other in the circumferential direction.

As described above, in the present embodiment, the control device 100 operates the electric motor 25 such that the upper table 7 ascends by a small amount when changing a mode between the first mode and the second mode.

This structure makes it possible to prevent the weight of the upper table 7 from acting on the respective engaging teeth when switching the fixed clutch tooth 46. This reduces wear on the engaging teeth, thereby increasing the life of the device.

In the above embodiment, a case has been described as an example in which a mode of the fixed clutch tooth 46 is switched from the second mode to the first mode. However, this control method can be applied even in a case in which a mode of the fixed clutch tooth 46 is switched from the first mode to the second mode.

Third Embodiment

Figure 7A:
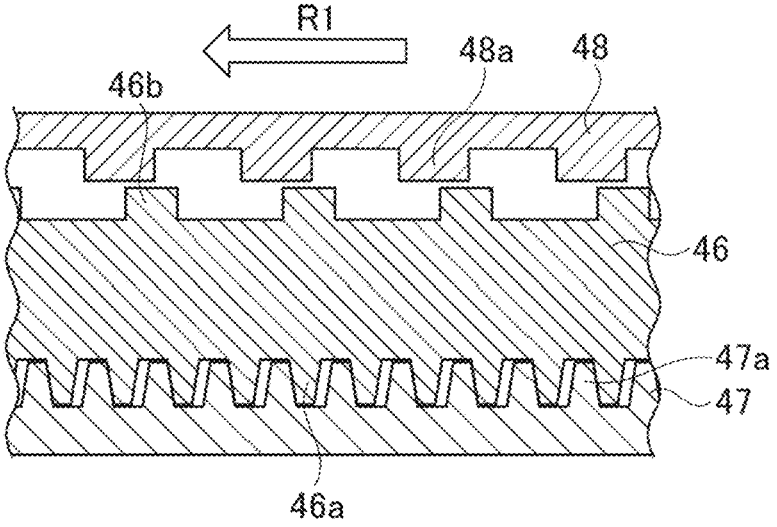
FIG. 7A is a diagram illustrating a method of controlling a clutch according to a third embodiment.

Hereinafter, a press brake 1 according to a third embodiment will be described. One of the features of the press brake 1 according to the third embodiment is a method of controlling the clutch 45 when changing a mode between the first mode and the second mode. Hereinafter, the method of controlling the clutch 45 will be described with reference to FIGS. 7A to 7C. Here, FIGS. 7A to 7C are diagrams for explaining the method of controlling the clutch according to the third embodiment.

In the following description, a case will be assumed in which a mode of the fixed clutch tooth 46 is switched from the first mode to the second mode. As illustrated in FIG. 7A, when changing a mode of the fixed clutch tooth 46 to the second mode, the tooth tips of the fourth engaging teeth 48*a* of the second clutch tooth 48 and the tooth tips of the second engaging teeth 46*b* of the fixed clutch tooth 46 may interfere with each other depending on the positional relationship between the second clutch tooth 48 and the fixed clutch tooth 46. In this case, a case occurs in which a mode of the fixed clutch tooth 46 cannot be changed to the second mode.

Therefore, before switching the mode from the first mode to the second mode, the control device 100 performs control (first control) to rotate the electric motor shaft 26 of the electric motor 25 in the rotational direction R1 by a predetermined rotational angle. The rotational angle in performing the control corresponds to an angle at which the second clutch tooth 48 positioned on the side where the fixed clutch tooth 46 moves rotates by a width corresponding to one tooth of the second clutch tooth 48 (the width of the fourth engaging teeth 48*a*). The rotational position of the fourth engaging teeth 48*a* of the second clutch tooth 48, that is, the tooth phase, is detected by a phase sensor such as a phototransistor. The control device 100 can rotate the second clutch tooth 48 by a width corresponding to one tooth in the predetermined rotational direction R1 based on the detection result of the phase sensor. Accordingly, the phase of the second clutch tooth 48 and the fixed clutch tooth 46 is shifted, and thus the tooth tips of the second engaging teeth 46*b* of the fixed clutch tooth 46 fit with the tooth gaps between the fourth engaging teeth 48*a* of the second clutch tooth 48. As a result, a mode of the fixed clutch tooth 46 can be changed to the second mode.

Figure 7B:
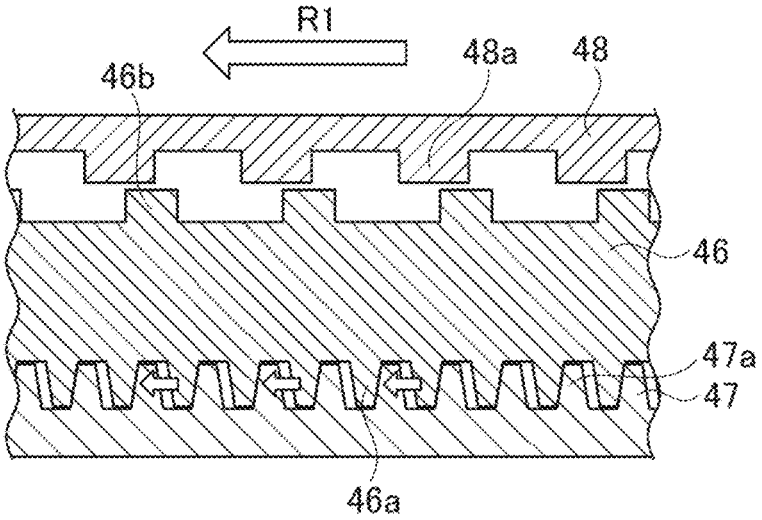
FIG. 7B is a diagram illustrating the method of controlling the clutch according to the third embodiment.
Figure 7C:
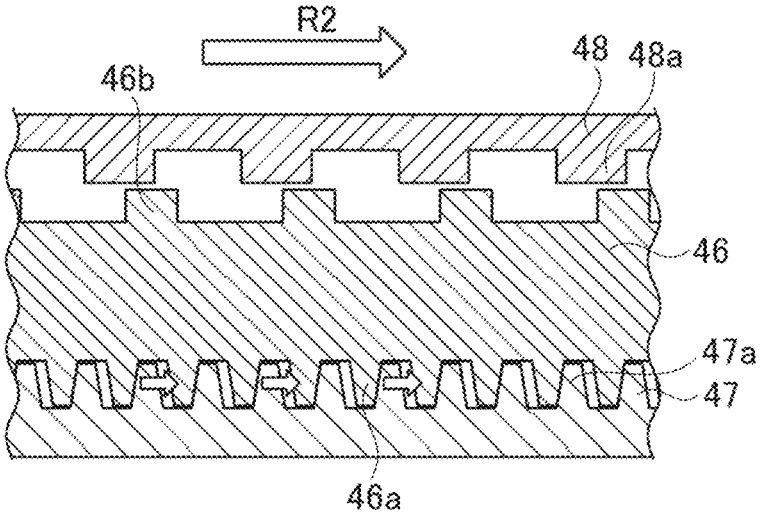
FIG. 7C is a diagram illustrating the method of controlling the clutch according to the third embodiment.

However, as illustrated in FIG. 7B, when the second clutch tooth 48 rotates in the rotational direction R1, a rotational force in the rotational direction R1 also acts on the first clutch tooth 47. At this time, if the first engaging teeth 46*a* of the fixed clutch tooth 46 are adjacent to the third engaging teeth 47*a* of the first clutch tooth 47 in the rotational direction R1 side, the third engaging teeth 47*a* are pressed against the first engaging teeth 46*a*. For this reason, a mode of the fixed clutch tooth 46 may not be changed to the second mode in a normal manner due to a frictional force generated between the fixed clutch tooth 46 and the first clutch tooth 47.

Therefore, when a mode of the fixed clutch tooth 46 is not switched from the first mode to the second mode even though the first control is performed, the control device 100 performs control (second control) to rotate the electric motor shaft 26 of the electric motor 25 in the backward rotation direction R2 by a predetermined rotation angle (a rotation angle corresponding to the width of one tooth). As a result, a clearance is generated between the third engaging teeth 47*a* of the first clutch tooth 47 and the first engaging teeth 46*a* of the fixed clutch tooth 46, and thus a mode of the fixed clutch tooth 46 can be changed from the first mode to the second mode.

As described above, in the present embodiment, the control device 100 performs the first control to control the electric motor 25 such that the clutch tooth 47 and the clutch tooth 48 positioned on the side where the fixed clutch tooth 46 is switched rotate by a width corresponding to one tooth when changing a mode between the first mode and the second mode.

This structure makes it possible to reduce the amount and time of movement of the upper table 7 in the upward direction or downward direction, since the amount of rotation of the clutch tooth 47 and the clutch tooth 48 is required to be small in performing a change of the mode. As a result, the time required for a change of the mode can be shortened.

In addition, in the present embodiment, the control device 100 performs the second control to control the electric motor 25 such that the clutch tooth 47 and the clutch tooth 48 rotate by a width corresponding to one tooth in a direction opposite to the first control, in a case where a mode cannot be changed between the first mode and the second mode even when performing the first control.

This structure makes it possible to change the mode reliably between the first mode and the second mode.

In the embodiment described above, the case has been described as an example in which a mode of the fixed clutch tooth 46 is switched from the first mode to the second mode. However, this control method can be applied even in a case in which a mode of the fixed clutch tooth 46 is switched from the second mode to the first mode.

In each of the embodiments described above, the rotation shafts of the electric motor 25 and the speed reducer unit 30 are arranged coaxially with the rotation shaft of the ball screw mechanism 55. However, the structure may be such that the rotation shafts of the electric motor 25 and the speed reducer unit 30 are arranged in parallel according to the rotation shaft of the ball screw mechanism 55, and the output unit 41 of the speed reducer unit 30 and the ball screw nut 56 of the ball screw mechanism 55 are connected by a timing belt to transmit power. This structure makes it possible to reduce the size in the up-down direction.

In each of the embodiments described above, the upper table 7 has been described as a movable table; however, the lower table 5 may be a movable table.

One of the features of the present embodiment is the structure of the press brake 1, and the table driving method for the press brake 1 described above is also given as one of the features of the present embodiment. That is, when driving the movable table in either the upward direction or the downward direction, the table driving method for the press brake 1 performs: a first step of operating the speed reducer at the second reduction ratio by meshing the fixed clutch tooth 46 only with the first clutch tooth 47 to fix the first rotation element; a second step of operating the speed reducer at the first reduction ratio by meshing the fixed clutch tooth 46 only with the second clutch tooth 48 to fix the second rotation element; and a third step of meshing the fixed clutch tooth 46 with each of the first clutch tooth 47 and the second clutch tooth 48 when changing a step between the first step and the second step.

According to the above method, since the speed reducer 31 includes the mechanical paradox planetary gear mechanism, a sufficiently large second reduction ratio can be acquired compared to the first reduction ratio. Accordingly, the operation performance required for the press brake 1 can be sufficiently acquired. Further, the fixed clutch tooth 46 operates in the both-engaging mode when changing a mode between the first mode and the second mode. Accordingly, the upper table 7, which is a heavy body, is maintained in an immovable state, and thus the upper table 7 can be prevented from descending unexpectedly.

The embodiments of the present disclosure have been described above, but the statements and drawings forming part of this disclosure should not be understood as limiting the invention. Various alternative embodiments, examples, and operating techniques will be apparent to those skilled in the art from this disclosure.

The disclosure of the present application relates to the subject matters described in Japanese Patent Application No. 2022-66193 filed on Apr. 13, 2022, and the entire disclosures of which are incorporated herein by reference.

The invention claimed is:

1. A press brake comprising:

a movable table that is disposed opposite to a fixed table in an up-down direction;

a conversion mechanism that moves the movable table in the up-down direction by converting a rotation motion into a linear motion;

an electric motor provided with an electric motor shaft;

a speed reducer that includes a mechanical paradox planetary gear mechanism, and outputs a rotation of the electric motor shaft to the conversion mechanism by reducing the rotation of the electric motor shaft at either a first reduction ratio or a second reduction ratio larger than the first reduction ratio; and a clutch that switches a reduction ratio in the speed reducer between the first reduction ratio and the second reduction ratio, wherein the clutch includes:

a first clutch tooth that is connected to a first rotation element included in the speed reducer and rotates integrally with the first rotation element;

a second clutch tooth that is connected to a second rotation element included in the speed reducer and rotates integrally with the second rotation element; and a rotationally fixed clutch tooth that is provided between the first clutch tooth and the second clutch tooth disposed to be opposite to each other such that a tooth structure of the first clutch tooth and a tooth structure of the second clutch tooth face each other, and axially moves between the first clutch tooth and the second clutch tooth, and the fixed clutch tooth configured to operate in a plurality of modes: as a switchable operation mode, a first mode in which the speed reducer operates at the second reduction ratio by meshing only with the first clutch tooth to fix the first rotation element;

a second mode in which the speed reducer operates at the first reduction ratio by meshing only with the second clutch tooth to fix the second rotation element; and a both-engaging mode of meshing with each of the first clutch tooth and the second clutch tooth when changing a mode between the first mode and the second mode.

2. The press brake according to claim 1, wherein the speed reducer includes:

a sun gear that rotates integrally with the electric motor shaft;

a plurality of planetary gear units having a first planetary gear that is engaged with the sun gear and rotates according to a rotation of the sun gear, and a second planetary gear that is provided coaxially with the first planetary gear and rotates integrally with the first planetary gear;

a planetary carrier as the second rotation element that rotatably supports the plurality of planetary gear units and rotates around the electric motor shaft;

a first internal gear as the first rotation element that is engaged with the first planetary gear;

a second internal gear that has the number of teeth different from those of the first internal gear and is engaged with the second planetary gear; and an output unit that is connected to the conversion mechanism and rotates integrally with the second internal gear.

3. The press brake according to claim 2, wherein the fixed clutch tooth is an annular member having a plurality of first engaging teeth, each of which projects toward the first clutch tooth side, and a plurality of second engaging teeth, each of which projects toward the second clutch tooth side, provided along a circumferential direction, the first clutch tooth is an annular member having a plurality of third engaging teeth, each of which projects toward the second clutch tooth side, provided along the circumferential direction, and the second clutch tooth is an annular member having a plurality of fourth engaging teeth, each of which projects toward the first clutch tooth side, provided along the circumferential direction.

4. The press brake according to claim 3, wherein in the first mode, a rotation of the first internal gear is restricted in a state in which the plurality of first engaging teeth and the plurality of third engaging teeth mesh with each other, and the plurality of second engaging teeth and the plurality of fourth engaging teeth are released, in the second mode, a rotation of the planetary carrier is restricted in a state in which the plurality of second engaging teeth and the plurality of fourth engaging teeth mesh with each other, and the plurality of first engaging teeth and the plurality of third engaging teeth are released, and in the both-engaging mode, the plurality of first engaging teeth and the plurality of third engaging teeth mesh with each other and the plurality of second engaging teeth and the plurality of fourth engaging teeth mesh with each other, thereby restricting a rotation of the first internal gear and the planetary carrier.

5. The press brake according to claim 1, wherein the clutch further includes:

a pressing member that presses the fixed clutch tooth toward the first clutch tooth side; and a solenoid that moves the fixed clutch tooth that is pressed toward the first clutch tooth side by the pressing member toward the second clutch tooth side by attracting the fixed clutch tooth using an electromagnetic force.

6. The press brake according to claim 1, further comprising:

a detection device that detects a position of the fixed clutch tooth between the first clutch tooth and the second clutch tooth; and a control device that controls the clutch and the electric motor based on a detection result of the detection device.

7. The press brake according to claim 6, wherein the control device operates the electric motor such that the movable table ascends when changing a mode between the first mode and the second mode.

8. The press brake according to claim 6, wherein the control device performs a first control to control the electric motor such that a clutch tooth positioned on a side where the fixed clutch tooth is switched rotates by a width corresponding to one tooth when changing a mode between the first mode and the second mode.

9. The press brake according to claim 8, wherein the control device performs a second control to control the electric motor such that the clutch tooth rotates by a width corresponding to one tooth in a direction opposite to the first control, in a case where a mode is not changed between the first mode and the second mode even when performing the first control.

10. The press brake according to claim 6, wherein the detection device includes:

a detection plate that is fixed to the fixed clutch tooth and extended to an outside of a housing for housing the clutch; and a sensor that is disposed outside the housing and detects the detection plate.

11. The press brake according to claim 5, wherein the clutch further includes a capacitor that supplies power to the solenoid when external power to the solenoid is interrupted.

12. A table driving method for a press brake, the press brake comprising:

a fixed table;

a movable table that is disposed opposite to the fixed table in an up-down direction;

an electric motor provided with an electric motor shaft;

a speed reducer that includes a mechanical paradox planetary gear mechanism, and outputs a rotation of the electric motor shaft by reducing the rotation of the electric motor shaft at either a first reduction ratio or a second reduction ratio larger than the first reduction ratio; and a clutch that switches a reduction ratio in the speed reducer between the first reduction ratio and the second reduction ratio; and a conversion mechanism that moves the movable table in the up-down direction by converting a rotation motion transmitted from the speed reducer into a linear motion, wherein the clutch includes:

a first clutch tooth that is connected to a first rotation element included in the speed reducer and rotates integrally with the first rotation element;

a second clutch tooth that is connected to a second rotation element included in the speed reducer and rotates integrally with the second rotation element; and a rotationally fixed clutch tooth that is provided between the first clutch tooth and the second clutch tooth disposed to be opposite to each other such that a tooth structure of the first clutch tooth and a tooth structure of the second clutch tooth face each other, and axially moves between the first clutch tooth and the second clutch tooth, and when driving the movable table in either an upward direction or a downward direction, the table driving method for the press brake includes:

a first step of operating the speed reducer at the second reduction ratio by meshing the fixed clutch tooth only with the first clutch tooth to fix the first rotation element;

a second step of operating the speed reducer at the first reduction ratio by meshing the fixed clutch tooth only with the second clutch tooth to fix the second rotation element; and a third step of meshing the fixed clutch tooth with each of the first clutch tooth and the second clutch tooth when changing a step between the first step and the second step.

* * * * *